US011840827B2

(12) United States Patent
Zhang et al.

(10) Patent No.: US 11,840,827 B2
(45) Date of Patent: Dec. 12, 2023

(54) PULL-OUT SPRAY OF PULL-OUT FAUCET

(71) Applicant: Xiamen Forbetter Sanitary Ware Co., Ltd., Fujian (CN)

(72) Inventors: Xingui Zhang, Xiamen (CN); Yihui Chen, Xiamen (CN); Mouyong Lin, Xiamen (CN)

( * ) Notice: Subject to any disclaimer, the term of this patent is extended or adjusted under 35 U.S.C. 154(b) by 149 days.

(21) Appl. No.: 17/686,360

(22) Filed: Mar. 3, 2022

(65) Prior Publication Data

US 2022/0282463 A1 Sep. 8, 2022

(30) Foreign Application Priority Data

Mar. 5, 2021 (CN) ..... 202110244573.9

(51) Int. Cl.
*E03C 1/04* (2006.01)

(52) U.S. Cl.
CPC ..... *E03C 1/0402* (2013.01); *E03C 1/0404* (2013.01); *E03C 1/0412* (2013.01); *E03C 2001/0414* (2013.01); *E03C 2001/0415* (2013.01)

(58) Field of Classification Search
CPC .... E03C 1/0402; E03C 1/0404; E03C 1/0412; E03C 2001/0414; E03C 2001/0415
See application file for complete search history.

(56) References Cited

U.S. PATENT DOCUMENTS

| | | | | |
|---|---|---|---|---|
| 4,935,991 | A * | 6/1990 | Tourney | A22C 25/06 452/173 |
| 8,355,822 | B2 * | 1/2013 | Jonte | E03C 1/057 700/282 |
| 8,365,767 | B2 * | 2/2013 | Davidson | G05D 23/1393 137/559 |
| 8,408,517 | B2 * | 4/2013 | Jonte | E03C 1/057 250/221 |
| 8,614,414 | B2 * | 12/2013 | Davidson | H03K 17/941 250/221 |
| 8,939,429 | B2 * | 1/2015 | Sawaski | E03C 1/057 251/129.04 |
| 8,944,105 | B2 * | 2/2015 | Rodenbeck | E03C 1/057 137/801 |
| 9,175,458 | B2 * | 11/2015 | Meehan | E03C 1/04 |
| 9,187,884 | B2 * | 11/2015 | Belz | F16K 31/0644 |
| 9,243,392 | B2 * | 1/2016 | Marty | H01C 1/01 |
| 9,285,807 | B2 * | 3/2016 | Rodenbeck | E03C 1/057 |
| 9,840,831 | B1 * | 12/2017 | Esche | E03C 1/0404 |
| 11,761,185 | B2 * | 9/2023 | Zhang | F16K 19/006 4/623 |
| 2006/0130907 | A1 * | 6/2006 | Marty | E03C 1/057 137/613 |

(Continued)

*Primary Examiner* — Craig M Schneider
*Assistant Examiner* — Frederick D Soski

(57) ABSTRACT

A pull-out spray of a pull-out faucet includes a spray head connected to a pull-out hose of the pull-out faucet and a sensor trigger fitted to a faucet body of the pull-out faucet. The spray head includes a spray head body, a solenoid valve, and a sensor switch controlled by the sensor trigger. The solenoid valve and the sensor switch are fitted to the spray head body. The solenoid valve is electrically connected to the sensor switch. The solenoid valve controls the spray head body to spray water or not according a control signal of the sensor switch. The spray head is controlled to spray water by pulling the spray head, thereby improving the use of the pull-out faucet.

13 Claims, 9 Drawing Sheets

(56) References Cited

U.S. PATENT DOCUMENTS

2006/0202142 A1* 9/2006 Marty ..... E03C 1/055 251/129.04
2007/0246564 A1* 10/2007 Rodenbeck ..... E03C 1/0404 239/588
2008/0271238 A1* 11/2008 Reeder ..... A46B 15/0055 4/597
2012/0017367 A1* 1/2012 Reeder ..... E03C 1/057 4/597
2013/0248617 A1* 9/2013 Sawaski ..... E03C 1/0404 239/73
2014/0069520 A1* 3/2014 Esche ..... B05B 15/65 137/315.01
2015/0013064 A1* 1/2015 Marty ..... H01C 1/14 4/668
2015/0292187 A1* 10/2015 Tseng ..... E03C 1/0412 4/677
2015/0368888 A1* 12/2015 Song ..... E03C 1/0404 137/78.1
2016/0177551 A1* 6/2016 Li ..... G01R 33/07 324/251
2016/0215482 A1* 7/2016 Fourman ..... E03C 1/0404
2017/0101766 A1* 4/2017 Blizzard ..... F16K 21/16
2017/0275860 A1* 9/2017 Beck ..... E03C 1/055
2018/0080203 A1* 3/2018 Frye ..... E03C 1/04
2018/0355593 A1* 12/2018 Tracy ..... E03C 1/057
2019/0063049 A1* 2/2019 Wang ..... F16K 37/0033
2019/0234055 A1* 8/2019 Gao ..... E03C 1/0404
2019/0330828 A1* 10/2019 Yan ..... E03C 1/057
2020/0123747 A1* 4/2020 Frackelton ..... E03C 1/057
2020/0340222 A1* 10/2020 Polly ..... E03C 1/0404
2022/0136224 A1* 5/2022 Yan ..... E03C 1/0403 4/623
2023/0133408 A1* 5/2023 Zhou ..... E03C 1/0405 4/676
2023/0139701 A1* 5/2023 Ye ..... E03C 1/057 4/678
2023/0140780 A1* 5/2023 Zhou ..... E03C 1/04 4/676

* cited by examiner

PULL-OUT SPRAY OF PULL-OUT FAUCET

BACKGROUND OF THE INVENTION

1. Field of the Invention

The present invention relates to a kitchen faucet, and more particularly to a pull-out spray of a pull-out faucet.

2. Description of the Prior Art

The switch of a traditional faucet uses a mechanical handle to turn on/off the faucet. With the development of infrared sensor technology, there are a large number of infrared sensor faucets on the market. That is, the infrared sensor faucet is equipped with a proximity sensor and mechanism that opens its valve to allow water to flow in response to the presence of a user's hands in close proximity. The faucet closes its valve again after a few seconds or when it no longer detects the presence of a user's hands.

However, the traditional switching method of the pull-out faucet has the following disadvantages:

1. It is not convenient enough to turn on/off the faucet through the mechanical handle;

2. Through the infrared sensor to turn on/off the faucet, the sensing range of the infrared sensor is small. When the user's hands are not in the sensing range, the valve of the faucet won't be opened to allow water to flow. Especially, for kitchen faucets, it is inconvenient for the infrared sensor faucets to control water to flow continuously. The use is inconvenient.

SUMMARY OF THE INVENTION

The primary object of the present invention is to provide a pull-out spray of a pull-out faucet, which can improve the use of the pull-out faucet effectively.

In order to achieve the above object, the present invention adopts the following solutions.

A pull-out spray of a pull-out faucet comprises a spray head connected to a pull-out hose of the pull-out faucet and a sensor trigger fitted to a faucet body of the pull-out faucet. The spray head includes a spray head body, a solenoid valve, and a sensor switch controlled by the sensor trigger. The solenoid valve and the sensor switch are fitted to the spray head body. The solenoid valve is electrically connected to the sensor switch. The solenoid valve controls the spray head body to spray water or not according a control signal of the sensor switch.

Preferably, the sensor trigger has an annular shape, and a side wall of the sensor trigger is provided with an elastic engaging protrusion.

Preferably, the sensor trigger is formed of a magnetic plastic material by injection molding, and the sensor switch is a magnetic induction switch.

Preferably, the spray head body includes an inner body and an outer casing sleeved on the inner body. The solenoid valve and the sensor switch are fitted in the outer casing. The inner body has a water outlet channel. The solenoid valve controls opening and closing of the water outlet channel of the inner body.

Preferably, the inner body further has a water inlet channel and a buffer channel. The water inlet channel is in communication with a first end of the buffer channel and an inlet end of the water outlet channel. A second end of the buffer channel is in communication with an outside of the inner body. An inner wall of the buffer channel is provided with a blocking edge. The spray head further includes a buffer assembly. The buffer assembly includes a buffer pad and a buffer spring. The buffer pad is movably fitted in the buffer channel. The buffer pad is hermetically fitted in the buffer channel. The buffer pad is located between the blocking edge and the first end of the buffer channel. The buffer spring is accommodated in the buffer channel. Both ends of the buffer spring abut against the blocking edge and the buffer pad, respectively.

Preferably, the water inlet channel and the buffer channel are arranged in parallel.

Preferably, one side of the inner body is recessed to form a mounting groove, and the solenoid valve is fitted in the mounting groove.

Preferably, the spray head body further includes a waterproof assembly. The waterproof assembly includes a first sealing ring and a second sealing ring. The first sealing ring and the second sealing ring are sandwiched between the outer casing and the inner body. A waterproof chamber is defined among the first sealing ring, the second sealing ring, the outer casing and the inner body. The solenoid valve and the sensor switch are fitted in the waterproof chamber.

Preferably, the spray head further includes a waterway switching device fitted with the inner body. The waterway switching device is located outside the waterproof chamber. The inner body further has at least two functional water cavities. The waterway switching device controls an outlet end of the water outlet channel to selectively communicate with one of the functional water cavities.

Preferably, the spray head further includes a sensor device fitted to the spray head body. The sensor device includes a first human body sensor and a second human body sensor that are electrically connected to the solenoid valve. A sensing direction of the first human body sensor is along a water spray direction of the spray head. A sensing direction of the second human body sensor faces one side of the spray head.

With the above solutions, the present invention can detect whether the spray head is pulled relative to the initial position through the cooperation between the sensor switch and the sensor trigger. When the spray head is in the initial position, the sensor switch senses the sensor trigger, so that the sensor switch controls the spray head not to spray water through the solenoid valve. When the spray head is pulled relative to the initial position, the sensor switch is separated from the sensor trigger, so that the sensor switch controls the spray head to spray water through the solenoid valve. In this way, the present invention can control the spray head to spray water by pulling the spray head. When the user pulls the spray head, water flows out of the spray head. It is convenient for the user to use the pull-out faucet. The use of the pull-out faucet is improved.

DETAILED DESCRIPTION OF THE PREFERRED EMBODIMENTS

Figure 1:
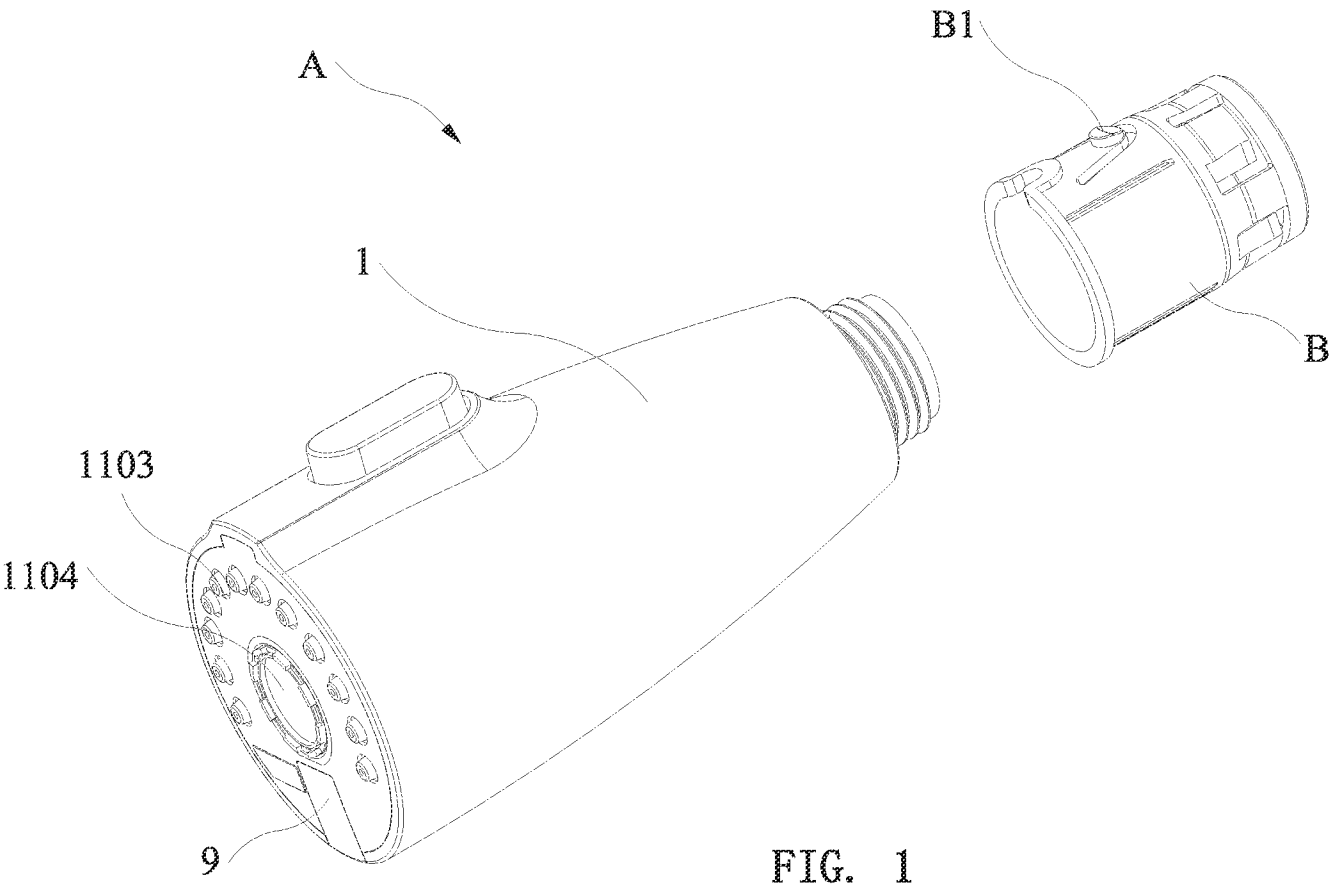
FIG. 1 is a perspective view of the present invention.
Figure 2:
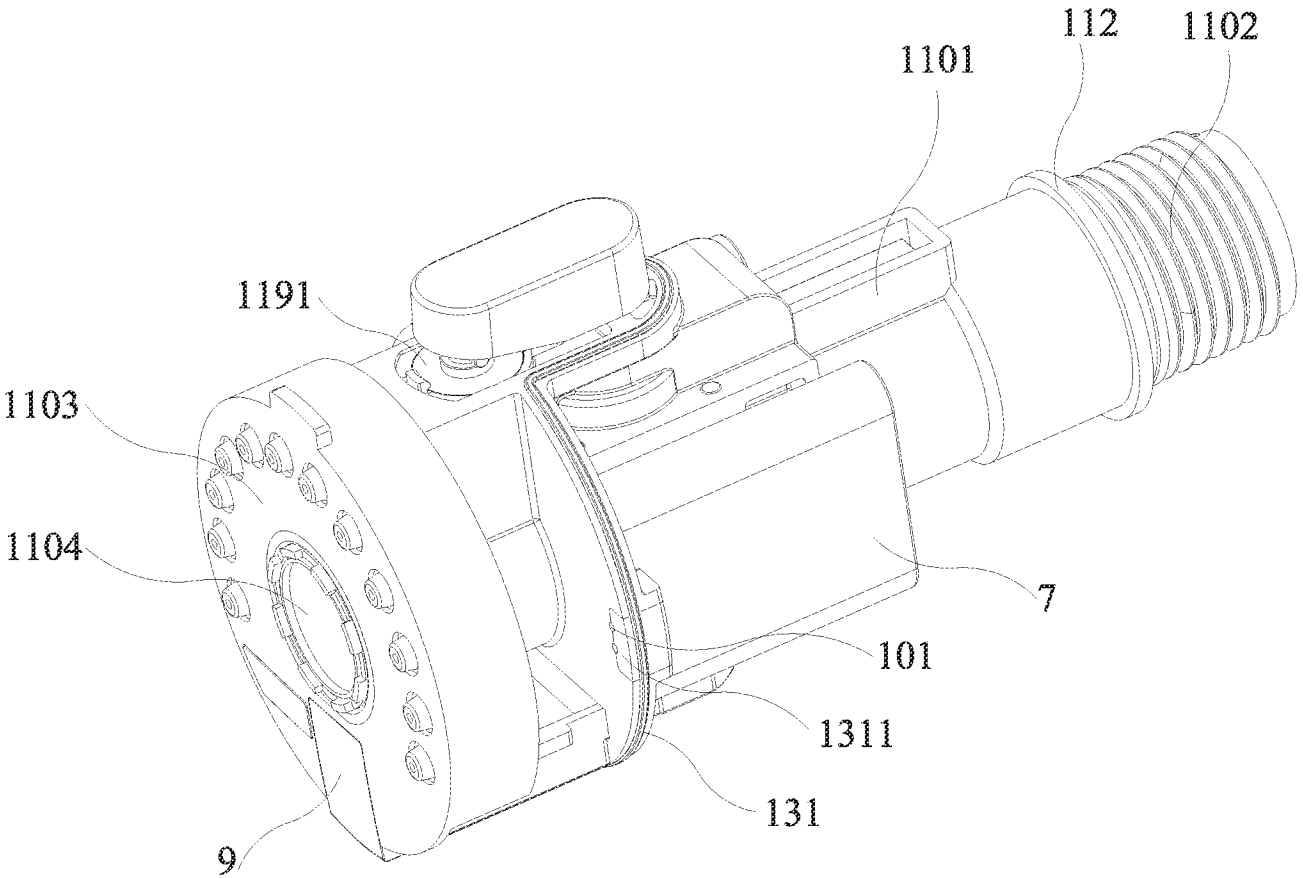
FIG. 2 is a first partial perspective view of the spray head of the present invention.

In order to further explain the technical solution of the present invention, embodiments of the present invention will now be described, by way of example only, with reference to the accompanying drawings.

As shown in FIG. 1 to FIG. 9, the present invention discloses a pull-out spray of a pull-out faucet, comprising a spray head A and a sensor trigger B. The spray head A is connected to a pull-out hose C of the pull-out faucet M. The sensor trigger B is fitted to a faucet body D of the pull-out faucet M. The sensor trigger B is configured to control the spray head A to spray water or not. As shown in FIG. 1 to FIG. 9, the spray head A includes a spray head body 1, a solenoid valve 2, and a sensor switch 3 controlled by the sensor trigger B. The solenoid valve 2 and the sensor switch 3 are fitted to the spray head body 1. The solenoid valve 2 is electrically connected to the sensor switch 3. The solenoid valve 2 controls the spray head body 1 to spray water or not according to the control signal of the sensor switch 3. The present invention can detect whether the spray head A is pulled relative to the initial position through the cooperation between the sensor switch 3 and the sensor trigger B. The initial position of the spray head A is the position where the spray head A is in contact with the faucet body D of the pull-out faucet M under the action of the water hammer of the pull-out faucet M. When the spray head A is in the initial position, the sensor switch 3 senses the sensor trigger B, so that the sensor switch 3 controls the spray head A not to spray water through the solenoid valve 2. When the spray head A is pulled relative to the initial position, the sensor switch 3 is separated from the sensor trigger B, so that the sensor switch 3 controls the spray head A to spray water through the solenoid valve 2. In this way, the present invention can control the spray head A to spray water by pulling the spray head A. When the user pulls the spray head A, water flows out of the spray head A. It is convenient for the user to use the pull-out faucet. The use of the pull-out faucet is improved.

The sensor trigger B may be a magnetic component. The sensor trigger B may be formed of a magnetic plastic material by injection molding. The sensor switch 3 is a magnetic induction switch (such as a reed switch or a Hall switch). When the spray head A is in the initial position, the magnetic field of the sensor trigger B triggers the sensor switch 3, so that the sensor switch 3 senses the sensor trigger B. When the spray head A is pulled relative to the initial position, the magnetic field of the sensor trigger B does not trigger the sensor switch 3, so that the sensor switch 3 does not sense the sensor trigger B. The sensor trigger B is fitted to the outlet end of the faucet body D of the pull-out faucet M. The spray head A is operatively connected to the outlet end of the faucet body D. The sensor trigger B has an annular shape so that the pull-out hose C can pass through the sensor trigger B. The side wall of the sensor trigger B is provided with an elastic engaging protrusion B1 so that the sensor trigger B can be firmly engaged in the outlet end of the faucet body D. It should be noted that the sensor switch 3 is not limited to the magnetic induction switch. The sensor switch 3 may be a micro switch, and the sensor trigger B is configured to press the micro switch. When the spray head A is in the initial position, the sensor trigger B presses the sensor switch 3 so that the sensor switch 3 senses the sensor trigger B. When the spray head A is pulled relative to the initial position, the sensor trigger B is released from the pressing of the sensor switch 3 so that the sensor switch 3 does not sense the sensor trigger B.

As shown in FIG. 4 to FIG. 8, the spray head body 1 includes an inner body 11 and an outer casing 12 sleeved on the inner body 1. The solenoid valve 2 and the sensor switch 3 are fitted in the outer casing 12. The outer casing 12 is configured to protect the solenoid valve 2 and the sensor switch 3. The inner body 11 has a water outlet channel 111. The solenoid valve 2 controls the opening and closing of the water outlet channel 111 of the inner body 11, so as to control the spy head A to spray water or not. As shown in FIG. 4 to FIG. 7, the spray head body 1 further includes a waterproof assembly 13. The waterproof assembly 13 includes a first sealing ring 131 and a second sealing ring 132. Both the first sealing ring 131 and the second sealing ring 132 are sandwiched between the outer casing 12 and the inner body 11. A waterproof chamber 10 is defined among the first sealing ring 131, the second sealing ring 132, the outer casing 12 and the inner body 11. The solenoid valve 2 and the sensor switch 3 are fitted in the waterproof chamber 10. The first sealing ring 131 and the second sealing ring 132 are configured to prevent water from flowing into the waterproof chamber 10, so as to prevent the solenoid valve 2 and the sensor switch 3 from being damaged due to water ingress. The inner body 11 may include an inner main body 1101 and a water inlet connector 1102. The inner main body 1101 has the water outlet channel 111. The water inlet connector 1102 and the inner main body 1101 are detachably connected by means of screw connection. A sealing member is provided between the water inlet connector 1102 and the inner main body 1101 to avoid water leakage. The water inlet connector 1102 is detachably connected to the inner main body 1101 so that the user can select a corresponding water inlet connector 1102 for connection according to different pull-out hoses C. The outer wall of the water inlet connector 1102 is provided with a connecting edge 112. The inner wall of the outer casing 12 is provided with a retaining edge 121. The water inlet connector 1102 is screwed to a fixing nut 14. The retaining edge 121 is sandwiched between the connecting edge 112 and the fixing nut 14 to retain the inner body 11 in the outer casing 12. The first sealing ring 131 is sandwiched between the outer casing 12 and the inner main body 1101. The second sealing ring 132 is sandwiched between the outer casing 12 and the water inlet connector 1102.

Figure 5:
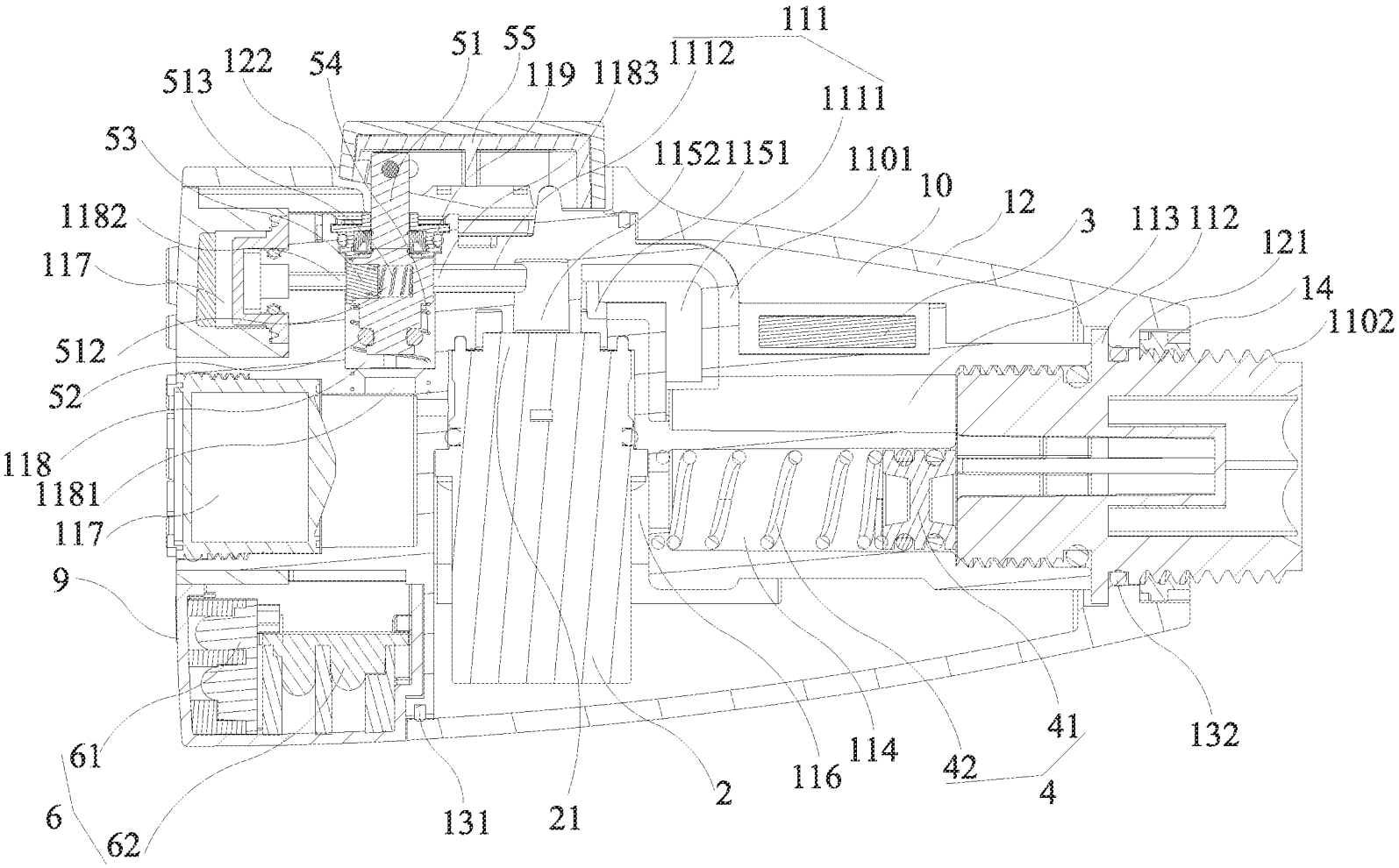
FIG. 5 is a first cross-sectional view of the spray head of the present invention.
Figure 6:
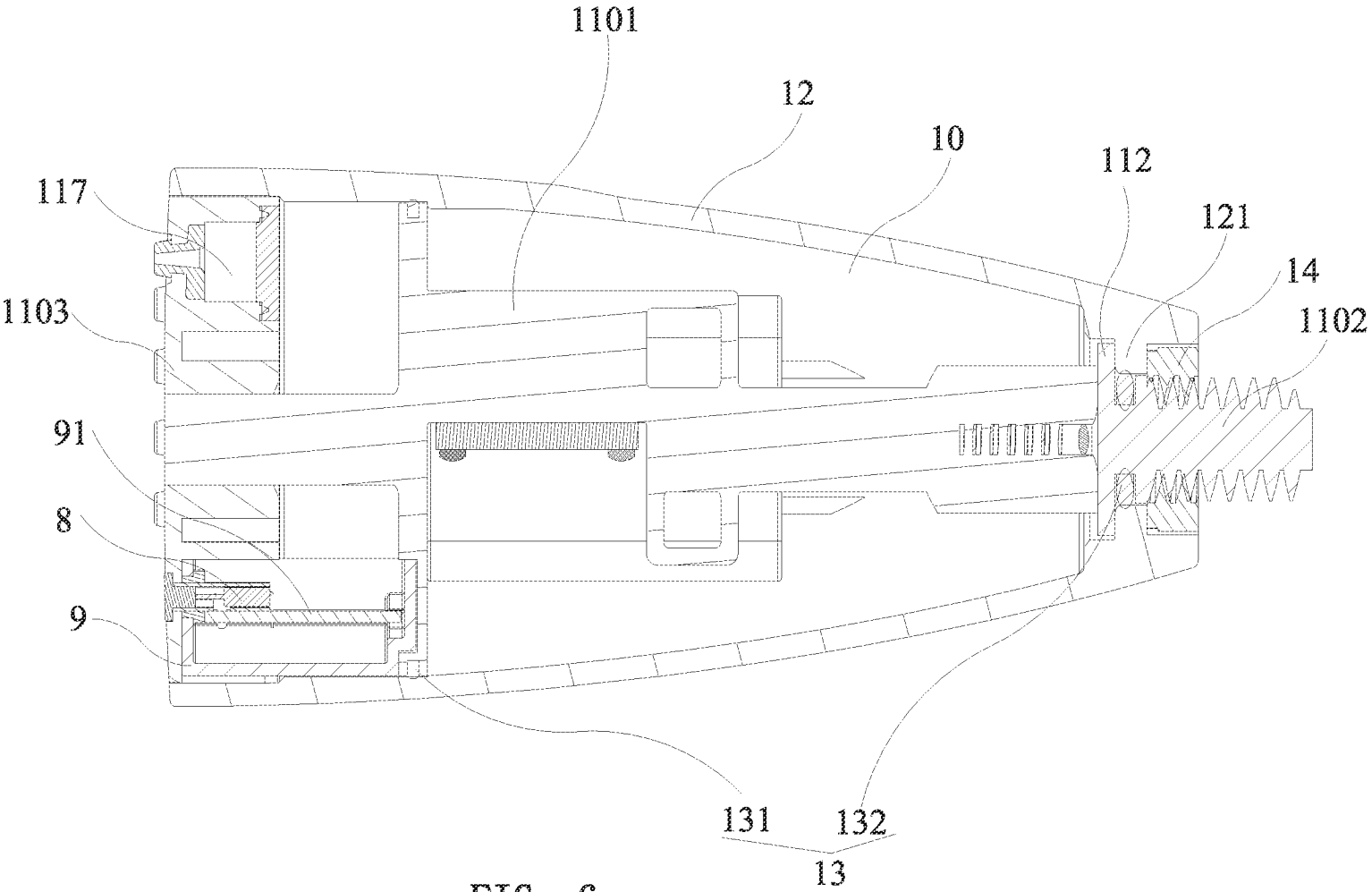
FIG. 6 is a second cross-sectional view of the spray head of the present invention.
Figure 7:
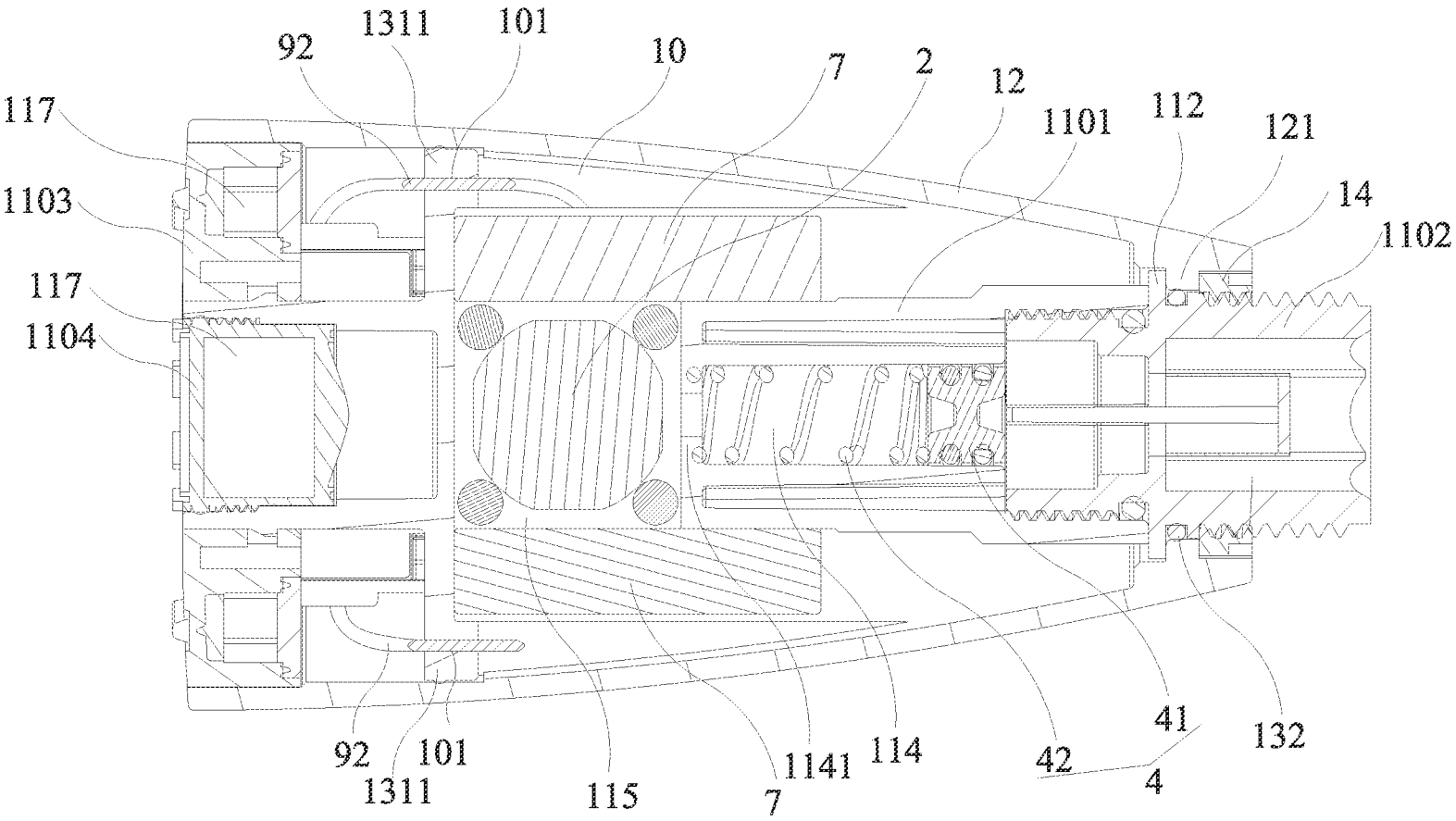
FIG. 7 is a third cross-sectional view of the spray head of the present invention.
Figure 8:
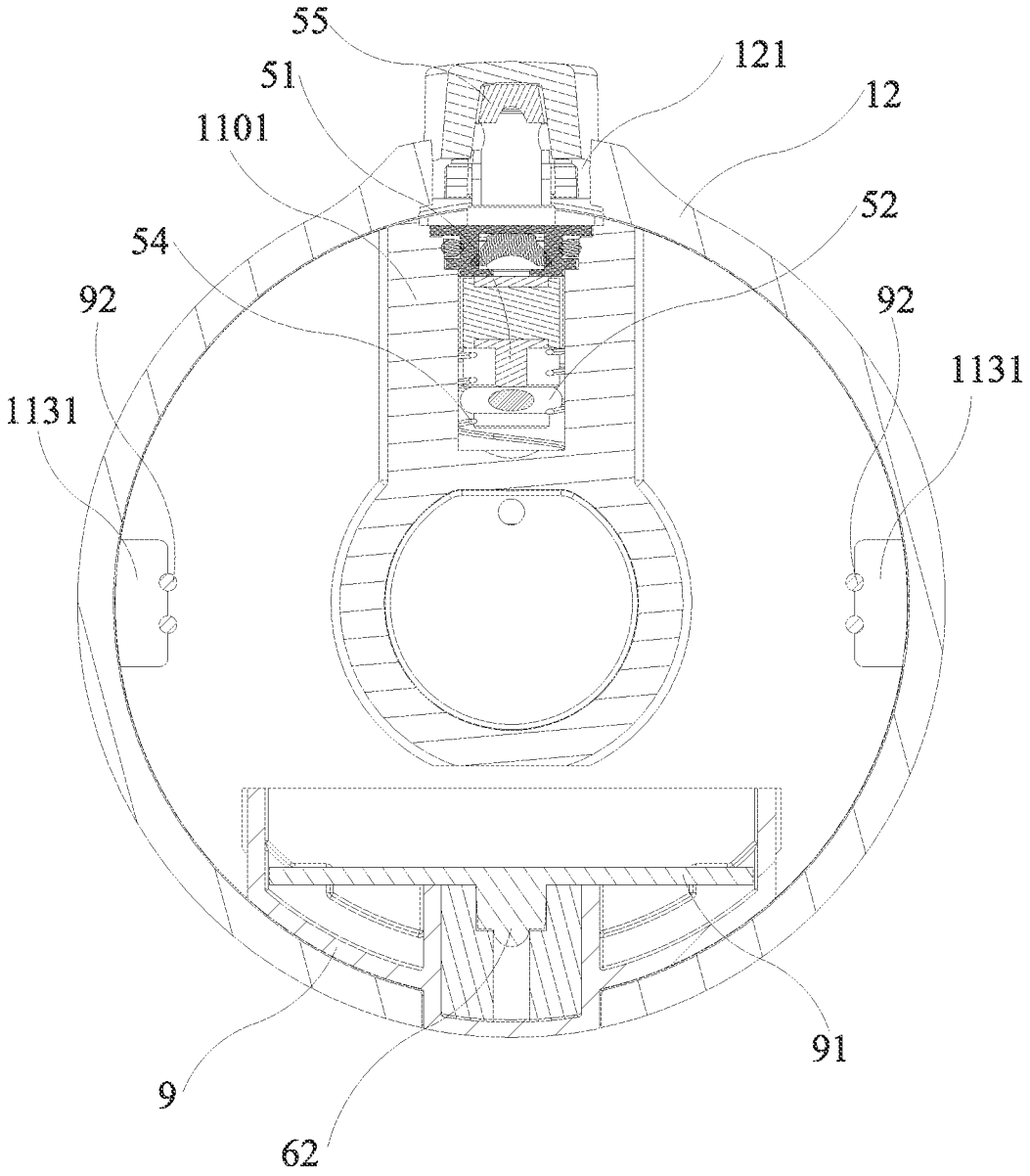
FIG. 8 is a fourth cross-sectional view of the spray head of the present invention.
Figure 9:
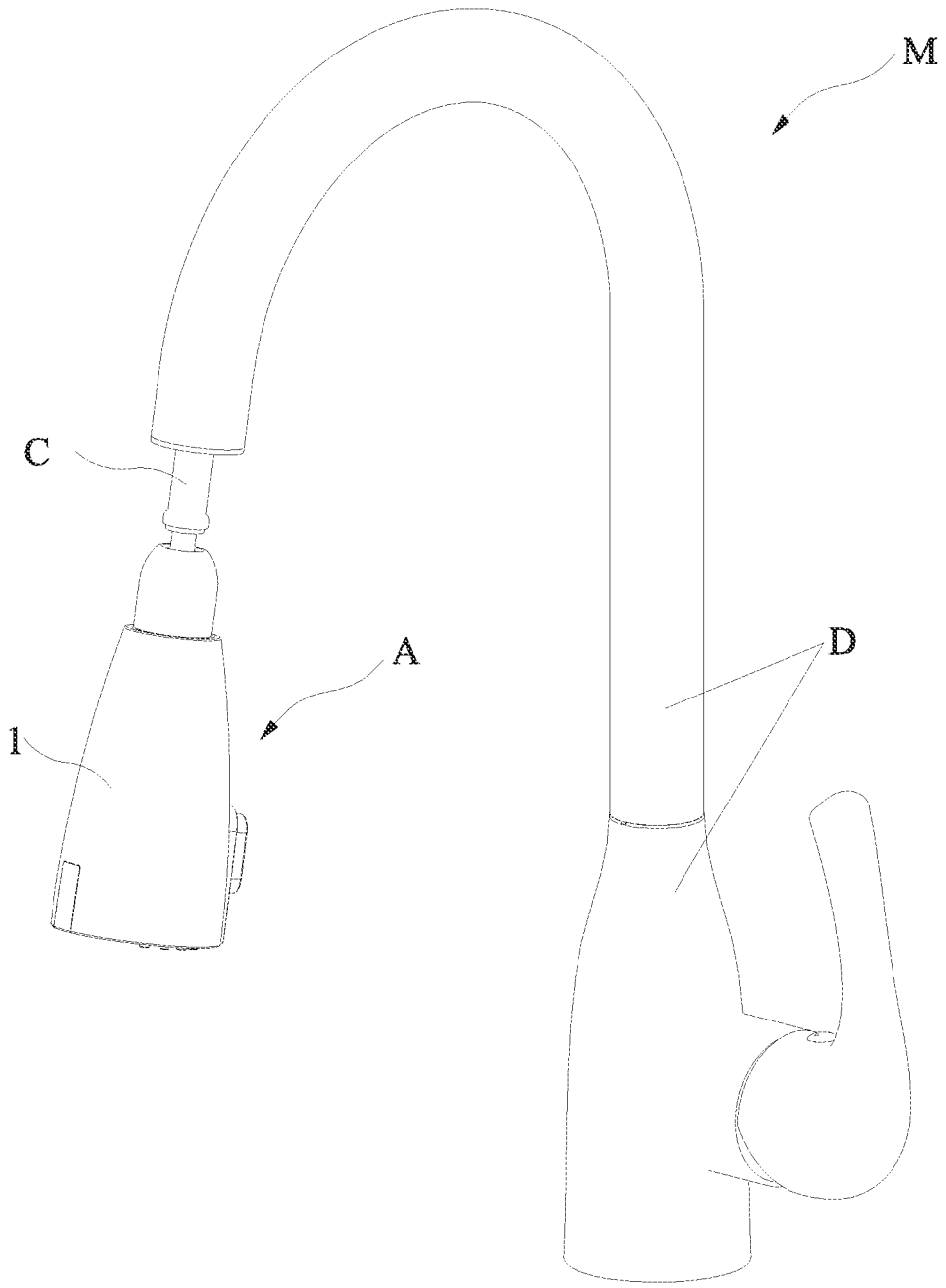
FIG. 9 is a schematic view of the present invention when in use.

As shown in FIG. 5, the inner body 11 further has a water inlet channel 113 and a buffer channel 114. The water inlet channel 113 and the buffer channel 114 are formed in the inner main body 1101. The inner cavity of the water inlet connector 1102 is in communication with the water inlet channel 113. The water inlet channel 113 is configured to introduce the water from the pull-out hose C. The water inlet channel 113 is in communication with a first end of the buffer channel 114. The water inlet channel 113 is also in communication with the inlet end of the water outlet channel 111. A second end of the buffer channel 114 is in communication with the outside of the inner body 11. The inner wall of the buffer channel 114 is provided with a blocking edge 1141. The spray head A further includes a buffer assembly 4. The buffer assembly 4 includes a buffer pad 41 and a buffer spring 42. The buffer pad 41 is movably fitted in the buffer channel 114. The buffer pad 41 is hermetically fitted in the buffer channel 114 to prevent water from leaking from the buffer channel 114. The buffer pad 41 is located between the blocking edge 1141 and the first end of the buffer channel 114. The buffer spring 42 is accommodated in the buffer channel 114. Both ends of the buffer spring 42 abut against the blocking edge 1141 and the buffer pad 41, respectively. According to the present invention, when the solenoid valve 2 closes the water outlet channel 111, the buffer pad 41 will move under the action of the water flow to compress the buffer spring 42, so that the buffer spring 42 can absorb the impact force of the water flow and avoid the vibration caused by the water hammer effect of the present invention. The water inlet channel 113 and the buffer channel 114 may be arranged in parallel, which can reduce the space occupied by the buffer assembly 4 accommodated in the buffer channel 114 in a direction perpendicular to the water inlet channel 113.

Figure 3:
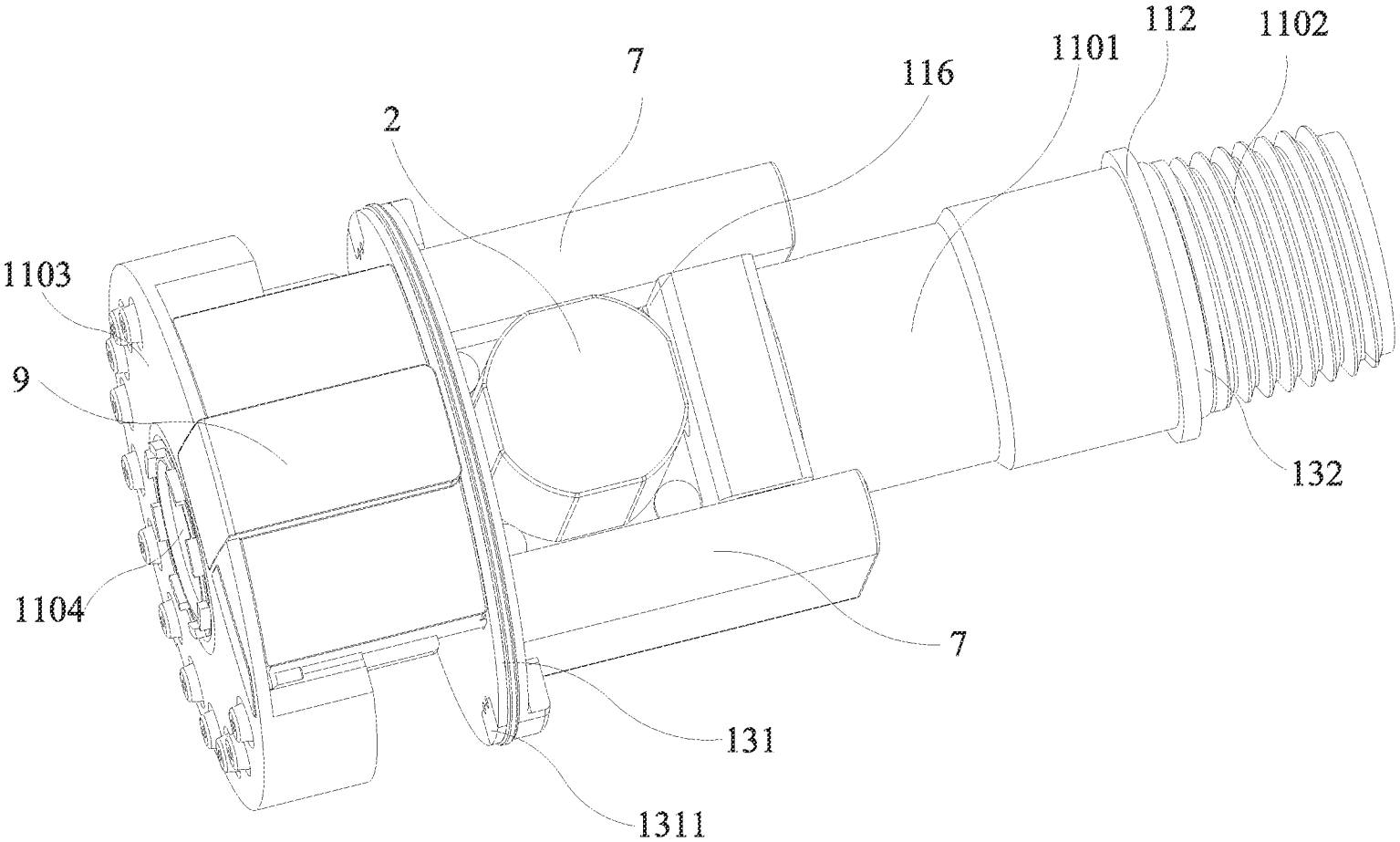
FIG. 3 is a second partial perspective view of the spray head of the present invention.
Figure 4:
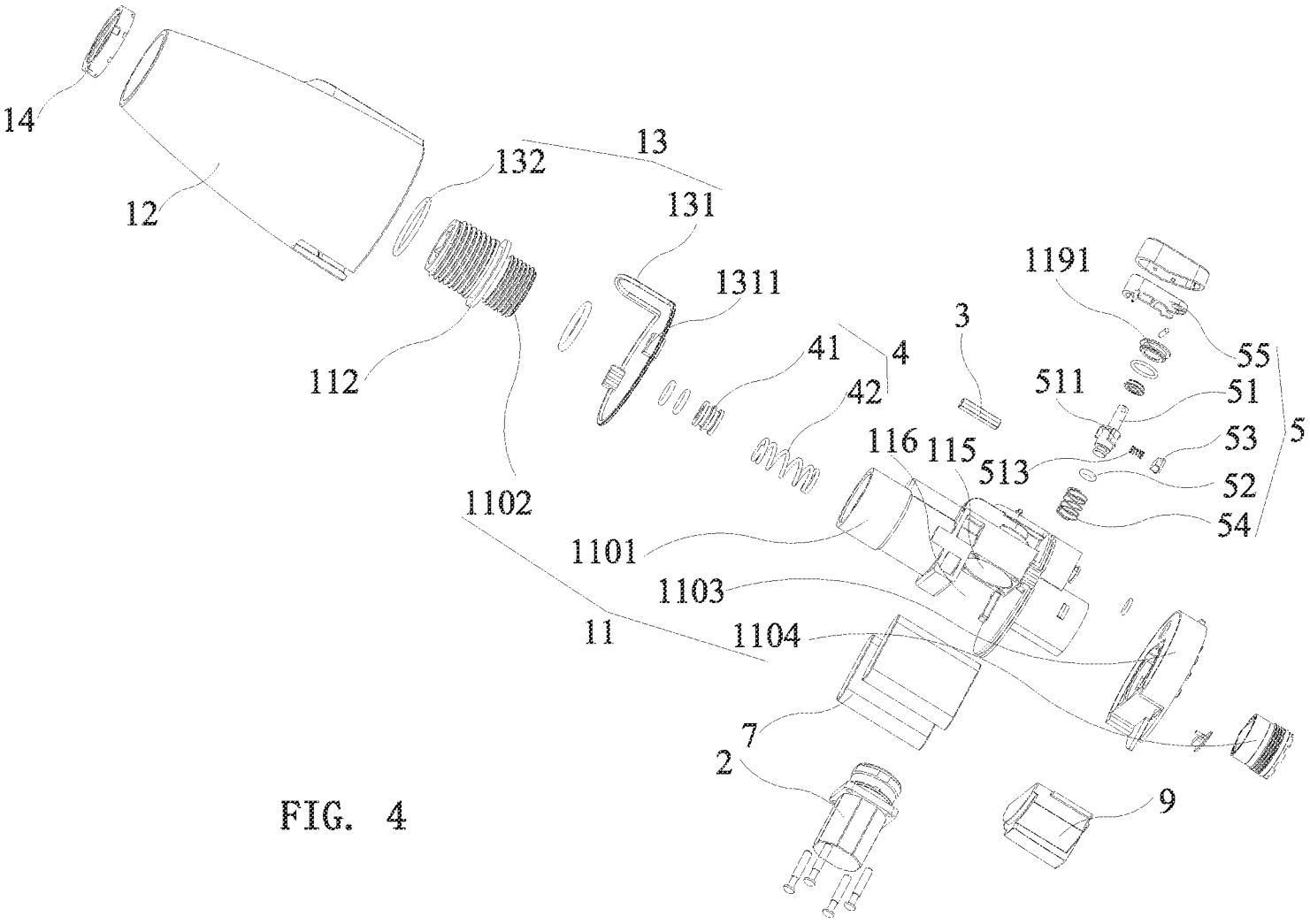
FIG. 4 is an exploded view of the spray head of the present invention.

As shown in FIG. 3 to FIG. 5, the inner body 11 is provided with a mounting seat 115. The mounting seat 115 is formed on the inner main body 1101. The inner cavity of the mounting seat 115 is provided with a water inlet 1151 and a water outlet 1152. The water outlet channel 111 includes a first channel 1111 and a second channel 1112. The first channel 1111 is in communication with the second channel 1112 through the inner cavity of the mounting seat 115. The inlet end of the first channel 1111 communicates with the water inlet channel 113. The outlet end of the first channel 1111 communicates with the water inlet 1151. The inlet end of the second channel 1112 communicates with the water outlet 1152. The outlet end of the second channel 1112 serves as the outlet end of the water outlet channel 111. The solenoid valve 2 is mounted to the mounting seat 115. The solenoid valve 2 is locked to the mounting seat 115 by bolts. A gasket is provided between the solenoid valve 2 and the mounting seat 115 to prevent water leakage. The solenoid valve 2 has a valve head 21 extending into the inner cavity of the mounting seat 115. The valve head 21 of the solenoid valve 2 is movable to block the water outlet 1152 for controlling the first channel 1111 to communicate with the second channel 1112 or not. As shown in FIG. 5, the side of the inner body 11 is recessed to form a mounting groove 116. The solenoid valve 2 is fitted in the mounting groove 116. In this way, the solenoid valve 2 and the inner body 11 overlap in the mounting space. This is beneficial to reduce the volume of the spray head of the present invention. The mounting groove 116 is disposed in the inner main body 1101. The mounting seat 115 is formed in the mounting groove 116.

As shown in FIG. 3 to FIG. 7, the spray head A further includes a waterway switching device 5 fitted with the inner body 11. The waterway switching device 5 is located outside the waterproof chamber 10. The inner body 11 further has at least two functional water cavities 117. The functional water cavities 117 are configured to output water flows with different spray effects so that the spray head A has at least two spray modes. The waterway switching device 5 controls the outlet end of the water outlet channel 111 to selectively communicate with one of the functional water cavities 117 for controlling the spray modes of the spray head A. The inner body 11 further includes a spray plate 1103 and an aerator 1104. A first functional water cavity is defined in the spray plate 1103 for outputting spray water. A second functional water cavity is defined in the aerator 1104 for outputting bubble water. The spray plate 1103 and the aerator 1104 are connected to the inner main body 1101. The inner main body 1101 has two water diversion channels to communicate with the first functional water cavity and the second functional water cavity. Because the waterway switching device 5 needs to be actuated when in use, the waterway switching device 5 is prone to water leakage after long-term use. Therefore, in the present invention, the waterway switching device 5 is arranged outside the waterproof chamber 10. In this way, even if the waterway switching device 5 leaks, the water from the waterway switching device 5 will not flow into the waterproof chamber 10. This can prevent the electronic device fitted in the waterproof chamber 10 from being damaged by water ingress due to water leakage of the waterway switching device 5.

As shown in FIG. 4 and FIG. 5, the inner body 11 has a switching cavity 118 therein. The outer wall of the inner body 11 is formed with a mounting opening 119 facing the switching cavity 118 and communicating with the switching cavity 118. The switching cavity 118 and the mounting cavity 119 may be arranged in the inner main body 1101. A valve seat 1191 is provided at the mounting opening 119. A sealing ring is provided between the valve seat 1191 and the mounting opening 119, so that the valve seat 1191 is hermetically fitted with the mounting opening 119. The bottom wall of the switching cavity 118 opposite to the mounting opening 119 is provided with a first water diversion opening 1181. The side wall of the switching cavity 118 is provided with a water opening 1183 and a second water dividing opening 1182. The water opening 1183 communicates with the outlet end of the water outlet channel 111. The inlet ends of the two functional water cavities 117 of the inner body 11 are respectively in communication with the first water diversion opening 1181 and the second water diversion opening 1182 through the water diversion channels. The waterway switching device 5 controls the water opening 1183 to selectively communicate with the first water diversion opening 1181 and the second water diversion opening 1182. The waterway switching device 5 includes a switching shaft 51, a first water stop pad 52, a second water stop pad 53, a return spring 54, and an operation button 55. The switching shaft 51 is movably inserted through the valve seat 1191. The switching shaft 51 is hermetically fitted with the valve seat 1191. The inner end of the switching shaft 51 is inserted into the switching cavity 118. The outer end of the switching shaft 51 is located outside the switching cavity 118. The outer end of the switching shaft 51 is hingedly connected to one end of the operation button 55. The other end of the operation button 55 is hingedly connected to the outer wall of the inner main body 1101 of the inner body 11. The outer casing 12 has an operation hole 122 corresponding to the operation button 55 for the user to press the operation button 55. The first water stop pad 52 and the second water stop pad 53 are movably accommodated in the switching cavity 118. The first water stop pad 52 is connected to the inner end of the switching shaft 51, and the first water stop pad 52 is movable to block the first water diversion opening 1181. The second water stop pad 53 is connected to the middle section of the switching shaft 51, and the second water stop pad 53 is movable to block the second water diversion opening 1182. The return spring 54 is disposed in the switching cavity 118, and the return spring 54 pushes against the switching shaft 51. The return spring 54 is used to drive the switching shaft 51 away from the first water diversion opening 1181. When the first water stop pad 52 blocks the first water diversion opening 1181, the second water stop pad 53 opens the second water diversion opening 1182, so that the second water diversion opening 1182 communicates with the water outlet channel 111. When the second water stop pad 53 blocks the second water diversion opening 1182, the first water stop pad 52 opens the first water diversion opening 1181, so that the first water diversion opening 1181 communicates with the water outlet channel 111. When the user presses the switching shaft 51 through the operation button 55, the switching shaft 51 is moved toward the first water diversion opening 1181 so that the first water stop pad 52 blocks the first water diversion opening 1181. When the user releases the switching shaft 51, the return spring 54 drives the switching shaft 51 away from the first water diversion opening 1181, so that the second water stop pad 53 blocks the second water diversion opening 1182. As shown in FIG. 4 and FIG. 5, the middle portion of the switching shaft 51 is provided with a mounting block 511. The side of the mounting block 511 has an engaging groove 512. The second water stop pad 53 is fitted into the engaging groove 512. A push spring 513 for pushing the second water stop pad 53 is fitted in the engaging groove 512. The push spring 513 is configured to drive the second water stop pad 53 to tightly abut against the side wall of the switching cavity 118, so that the second water stop pad 53 can tightly seal the second water diversion opening 1182.

As shown in FIG. 4, the spray head A further includes a sensor device 6 fitted to the spray head body 1. The sensor device 6 includes a first human body sensor 61 and a second human body sensor 62 that are electrically connected to the solenoid valve 2. The sensing direction of the first human body sensor 61 is along the water spray direction of the spray head A. The sensing direction of the second human body sensor 62 faces the side of the spray head A. The first human body sensor 61 and the second human body sensor 62 may be ultrasonic sensors or infrared human body sensors. The first human body sensor 61 controls the solenoid valve 2 as follows: when the first human body sensor 61 senses the presence of the user (for example, the user's hands are in front of the first human body sensor 61), the solenoid valve 2 is controlled to be turned on; when the first human body sensor 61 senses the absence of the user), the solenoid valve 2 is controlled to be turned off, thereby saving water. The sensing direction of the first human body sensor 61 is along the water spray direction of the spray head A, so that when the user place his/her hands under the water outlet of the spray head A for cleaning, the first human body sensor 61 can sense the user's hands and the spray head A can spray water for a period of time. It is convenient for the user to clean his/her hands. The second human body sensor 62 controls the solenoid valve 2 as follows: each time the human body sensor 62 senses a human body signal (for example, the user's hands are in front of the second human body sensor 62), the solenoid valve 2 is controlled to switch to an on state once. Therefore, the spray head A can be controlled to spray water for a period of time by means of sensor control. It is convenient for the user to use the spray head. The first human body sensor 61 and the second human body sensor 62 are electrically connected to a control circuit board 91. The control circuit board 91 is electrically connected to the solenoid valve 2 through a wire 92.

As shown in FIGS. 3 to 8, the spray head body 1 of the spray head A may be provided with a built-in power supply for power supply. In this way, the spray head A is directly powered by the built-in power supply when in use, so that there is no need for the spray head A to be connected to the mains electricity through a power cord when in use, thereby improving the convenience of use. The power supply includes a battery 7 arranged in the waterproof chamber 10. The battery 7 can be charged through a charging interface 8. The charging interface 8, the sensor device 6 and the control circuit board 91 are all arranged outside the waterproof chamber 10. The charging interface 8, the sensor device 6 and the control circuit board 91 are installed in a retaining housing 9. The retaining housing 9 is fitted to the spray plate 1103. The charging interface 8 and the sensor device 6 are electrically connected to the control circuit board 91. The control circuit board 91 is electrically connected to the solenoid valve 2 and the battery 7 through the wire 92. The first sealing ring 131 may be provided with an elastic sealing block 1311. The elastic sealing block 1311 is embedded in the outer wall of the inner main body 1101 of the inner body 11. A wire hole 101 for the wire 92 to pass through is formed between the elastic sealing block 1311 and the outer wall of the inner main body 1101 of the inner body 11. The wire 92 is hermetically fitted with the wire hole 101 to prevent water from flowing into the waterproof chamber 10.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pull-out spray of a pull-out faucet, comprising a spray head connected to a pull-out hose of the pull-out faucet and a sensor trigger fitted to a faucet body of the pull-out faucet;

the spray head including a spray head body, a solenoid valve and a sensor switch controlled by the sensor trigger; the solenoid valve and the sensor switch being fitted to the spray head body, the solenoid valve being electrically connected to the sensor switch, the solenoid valve controlling the spray head body to spray water or not according to a control signal of the sensor switch.

2. The pull-out spray of the pull-out faucet as claimed in claim 1, wherein the spray head body includes an inner body and an outer casing sleeved on the inner body; the solenoid valve and the sensor switch are fitted in the outer casing, the inner body has a water outlet channel, and the solenoid valve controls opening and closing of the water outlet channel of the inner body.

3. The pull-out spray of the pull-out faucet as claimed in claim 2, wherein the inner body further has a water inlet channel and a buffer channel; the water inlet channel is in communication with a first end of the buffer channel and an inlet end of the water outlet channel, a second end of the buffer channel is in communication with an outside of the inner body, an inner wall of the buffer channel is provided with a blocking edge;

the spray head further includes a buffer assembly, the buffer assembly includes a buffer pad and a buffer spring, the buffer pad is movably fitted in the buffer channel, the buffer pad is hermetically fitted in the buffer channel, the buffer pad is located between the blocking edge and the first end of the buffer channel, the buffer spring is accommodated in the buffer channel, and both ends of the buffer spring abut against the blocking edge and the buffer pad, respectively.

4. The pull-out spray of the pull-out faucet as claimed in claim 3, wherein the water inlet channel and the buffer channel are arranged in parallel.

5. The pull-out spray of the pull-out faucet as claimed in claim 4, wherein one side of the inner body is recessed to form a mounting groove, and the solenoid valve is fitted in the mounting groove.

6. The pull-out spray of the pull-out faucet as claimed in claim 3, wherein one side of the inner body is recessed to form a mounting groove, and the solenoid valve is fitted in the mounting groove.

7. The pull-out spray of the pull-out faucet as claimed in claim 2, wherein the spray head body further includes a waterproof assembly; the waterproof assembly includes a first sealing ring and a second sealing ring, the first sealing ring and the second sealing ring are sandwiched between the outer casing and the inner body, a waterproof chamber is defined among the first sealing ring, the second sealing ring, the outer casing and the inner body, and the solenoid valve and the sensor switch are fitted in the waterproof chamber.

8. The pull-out spray of the pull-out faucet as claimed in claim 7, wherein the spray head further includes a waterway switching device fitted with the inner body; the waterway switching device is located outside the waterproof chamber; the inner body further has at least two functional water cavities, and the waterway switching device controls an outlet end of the water outlet channel to selectively communicate with one of the functional water cavities.

9. The pull-out spray of the pull-out faucet as claimed in claim 2, wherein one side of the inner body is recessed to form a mounting groove, and the solenoid valve is fitted in the mounting groove.

10. The pull-out spray of the pull-out faucet as claimed in claim 1, wherein the sensor trigger has an annular shape, and a side wall of the sensor trigger is provided with an elastic engaging protrusion.

11. The pull-out spray of the pull-out faucet as claimed in claim 10, wherein the sensor trigger is formed of a magnetic plastic material by injection molding, and the sensor switch is a magnetic induction switch.

12. The pull-out spray of the pull-out faucet as claimed in claim 1, wherein the sensor trigger is formed of a magnetic plastic material by injection molding, and the sensor switch is a magnetic induction switch.

13. The pull-out spray of the pull-out faucet as claimed in claim 1, wherein the spray head further includes a sensor device fitted to the spray head body, the sensor device includes a first human body sensor and a second human body sensor that are electrically connected to the solenoid valve, a sensing direction of the first human body sensor is along a water spray direction of the spray head, and a sensing direction of the second human body sensor faces one side of the spray head.

* * * * *